United States Patent [19]

deJong

[11] 4,395,160

[45] Jul. 26, 1983

[54] TENSIONING SYSTEM FOR MARINE RISERS AND GUIDELINES

[75] Inventor: Sijtze deJong, San Jose, Calif.

[73] Assignee: Lockheed Corporation, Burbank, Calif.

[21] Appl. No.: 216,800

[22] Filed: Dec. 16, 1980

[51] Int. Cl.[3] ..... E02B 17/00

[52] U.S. Cl. ..... 405/195; 74/110; 114/264; 166/367; 405/198

[58] Field of Search ..... 405/195, 198, 224; 74/110; 114/264, 265; 166/350, 359, 367; 175/7; 254/95–97

[56] References Cited

U.S. PATENT DOCUMENTS

| | | | |
|---|---|---|---|
| 3,311,063 | 3/1967 | Grable | 166/359 X |
| 3,525,102 | 8/1970 | Braun | 74/110 X |
| 3,540,396 | 11/1970 | Horton | 114/265 |
| 3,760,875 | 9/1973 | Busking | 166/359 X |
| 4,135,841 | 1/1979 | Watkins | 175/7 X |

*Primary Examiner*—David H. Corbin
*Attorney, Agent, or Firm*—John J. Morrissey

[57] ABSTRACT

A double rack and pinion device (17) is used to maintain substantially constant upward tension on a marine riser (16) that extends from stationary equipment (11) on the ocean floor to a floating structure (10) on the ocean surface. A preferred embodiment of the double rack and pinion device (17) comprises a sleeve (21) fitted over an upper segment of the riser (16), with a generally cylindrical weighted structure (40) surrounding the sleeve (21). Racks (33, 34, 35) are secured to or formed integrally on the exterior surface of the sleeve (21), and corresponding racks (53, 54, 55) are secured to the interior surface of the weighted structure (40). Pinions (63, 64, 65) are supported by the floating structure (10), and extend into the spacing between corresponding pairs of racks on the sleeve (21) and on the weighted structure (40). Thus, teeth on the pinion (63) engage teeth on the racks (33 and 53), teeth on the pinion (64) engage teeth on the racks (34 and 54), and teeth on the pinion (65) engage teeth on the racks (35 and 65). The gravitational force downward on the weighted structure (40) causes a torque to be applied by the racks (53, 54, 55) to the pinions (63, 64, 65), thereby tending to rotate the pinions (63, 64, 65). Concomitantly, the pinions (63, 64, 65) exert an upward force on the racks (33, 34, 35) tending to urge the sleeve (21) upward. Upward movement of the sleeve (21) is restrained, however, by a collar (22) affixed to or formed integrally on the upper segment of the riser (16). As the floating structure (10) changes position on the ocean surface due to environmental forces, vertical motion is imparted to the pinions (63, 64, 65). The pinions (63, 64, 65) travel up and down along the racks (33, 34, 35), producing concomitant vertical motion of the weighted structure (40) relative to the riser (16). In this way, a substantially constant upward tensioning force is exerted on the riser (16) regardless of the position of the floating structure (10) relative to the stationary equipment (11).

46 Claims, 10 Drawing Figures

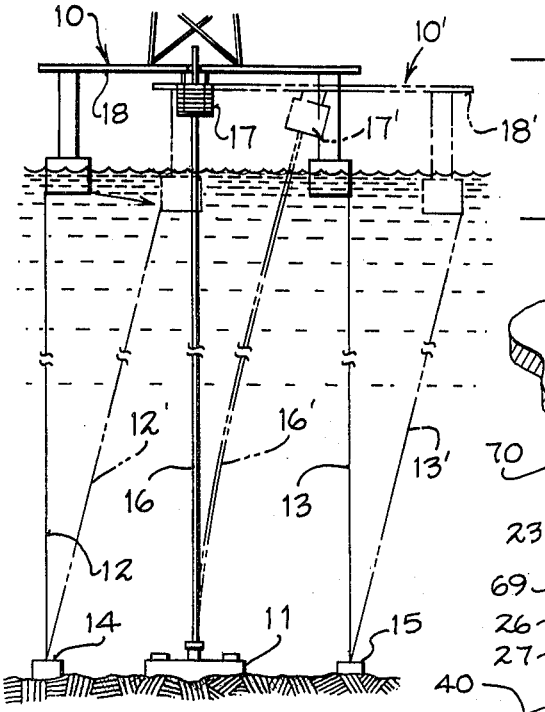
FIG_2
FIG_3
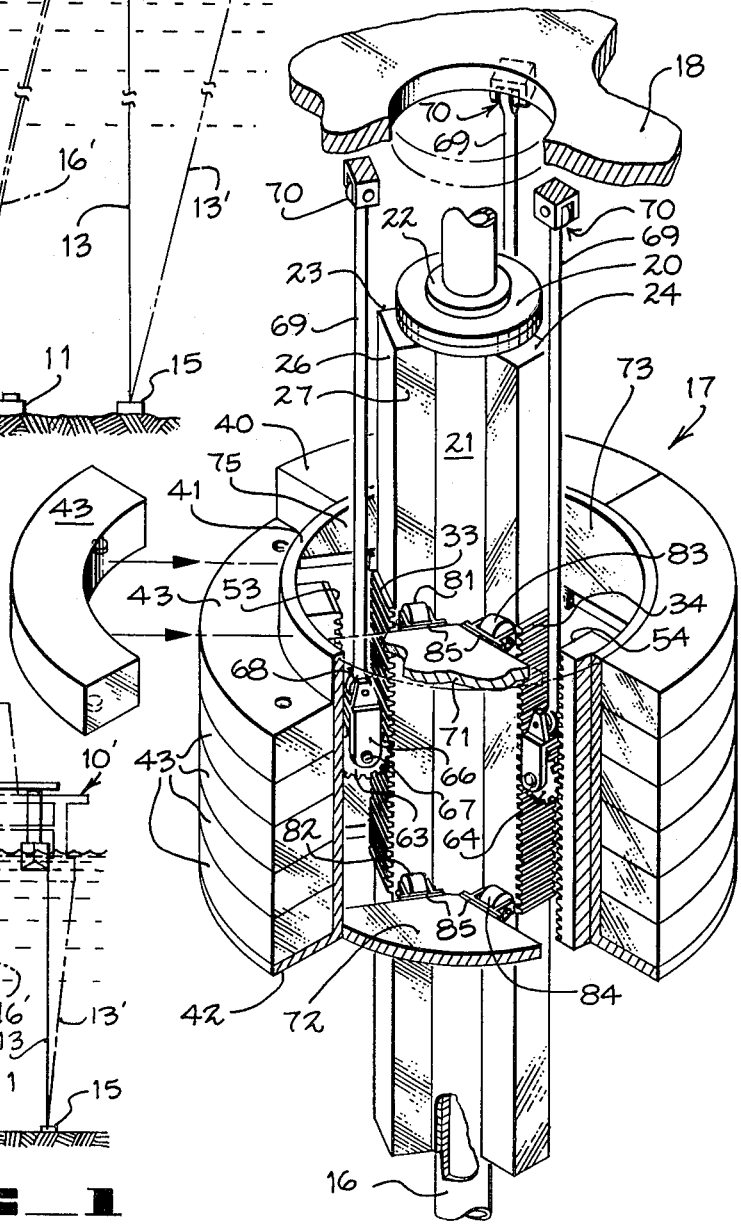
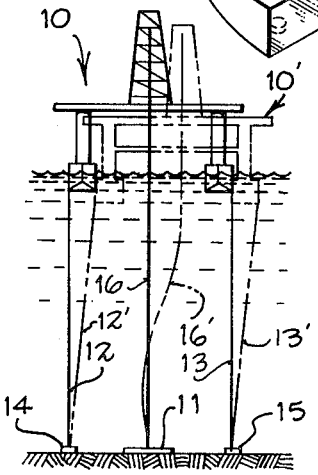
FIG_1

TENSIONING SYSTEM FOR MARINE RISERS AND GUIDELINES

TECHNICAL FIELD

This invention pertains to the tensioning of marine risers and guidelines as used in offshore drilling and production operations.

BACKGROUND ART

The recovery of energy resources (e.g., petroleum and other fluid hydrocarbons, or geothermal resources) from a deposit beneath the ocean floor conventionally involves a drilling operation to reach the deposit, and a production operation to bring the resources from the undersea deposit to the ocean surface. An offshore drilling and production operation generally requires a buoyant structure such as a vessel or other floating structure on the ocean surface, stationary equipment positioned on the ocean floor, and a conduit structure extending between the buoyant structure and the stationary equipment.

In a drilling operation, a conduit structure called a "drilling riser" extends between the buoyant structure on the ocean surface and the stationary equipment at the drilling site on the ocean floor. The stationary equipment for a drilling operation usually includes a blowout preventor (customarily called a "BOP"), which is lowered along with the drilling riser from the buoyant structure to the drilling site. Coupling of the drilling riser to the BOP is conventionally accomplished using a remotely operated connector. The drilling riser encloses a pipe (called a "drill string"), which is attached to a bit for drilling a hole in the ocean floor to the energy resource deposit. The drilling riser and the drill string thus form concentric conduits. A viscous fluid material (called "drill mud") for controlling down-hole pressure and for washing away drilling debris is passed down the drill string to where the drill bit cuts into the ocean floor, and the resulting mixture of drill mud and debris (called "return mud") is forced up the annular region between the drill string and the drilling riser to the buoyant structure on the ocean surface. Typically, the drilling riser also supports external tubular hydraulic conduits and/or electrical cabling for powering and/or controlling the BOP and the remotely operated connector.

In a production operation, a conduit structure called a "production riser" extends between the buoyant structure on the ocean surface and the stationary equipment at the production site (i.e., the well) on the ocean floor. The stationary equipment for a production operation usually includes a retrievable assembly of valves and piping (called a "subsea manifold") for connecting flow lines leading from the well to one or more transport conduits enclosed within the production riser. Depending on the particular surface arrangements for storage and loading of the energy resource recovered from the undersea deposit, the production riser may also enclose tubes through which the energy resource can be pumped back to storage containers on the ocean floor. Coupling of the production riser to the subsea manifold is conventionally accomplished using a remotely operated connector. The production riser can also be used to enclose or support tubular hydraulic conduits and/or electric cabling for powering and/or controlling the subsea manifold, the remotely operated connector and other production equipment.

In installing stationary equipment on the ocean floor for a drilling or production operation, proper orientation and positioning of the equipment is usually of major importance. A customary technique for achieving proper orientation and positioning of the stationary equipment utilizes two or more guidelines extending from the buoyant structure to the site at which the equipment is to be installed on the ocean floor. The guidelines are kept very taut in the vertical direction by upwardly directed tensioning forces. The equipment is then secured to the guidelines so that, as the equipment is being lowered to the ocean floor, downward vertical motion parallel to the guidelines is the only motion possible for the equipment. The guidelines prevent rotation and lateral displacement of the equipment away from the required orientation for proper installation.

Usually, a marine riser is run downward from the floating structure to the ocean floor is discrete cylindrical pipe segments. The pipe segments are attached to each other, one after the other, until the complete riser is formed.

In operation, marine risers and guidelines must be kept under substantially constant upward tension. Drilling and production risers, if not kept taut by a constant upward tension, would be damaged or destroyed by compressional loading that would cause the risers to buckle and bend. Similarly, guidelines, if not kept taut by a constant upward tension, would become slack and be incapable of properly orienting and positioning the equipment being lowered to the ocean floor.

Local conditions (e.g., waves, tides, winds, surface and subsurface currents, and other phenomena occurring in a marine environment) cause a buoyant object floating on the surface of the ocean or other body of water to undergo a variety of motions. In particular, a vessel or other type of floating structure used in offshore drilling and/or production operations heaves and sways on the ocean surface in response to such local maritime conditions. The magnitude of the heaving and swaying of the floating structure is dependent upon the hull form response characteristics of the floating structure, as well as upon the type of mooring or positioning system used to maintain station over the drilling or production site, and upon changes in the draft of the floating structure. Thus, for example, a typical ship-shaped hull in a conventional mooring arrangement would undergo more pronounced heaving and swaying than a semi-submersible floating platform of the tension leg type. Nevertheless, regardless of any heaving and swaying motions of the floating structure on the ocean surface, the marine risers and guidelines used in an offshore drilling and/or production operation must be maintained at a substantially constant upward tension.

The required upward tensioning force on a marine riser is ordinarily applied at or near the upper end of the riser to overcome the compressional loading due to gravity, which is proportional to the weight (and therefore to the length) of the riser. For drilling and production operations in very deep water, it may also be advantageous in certain applications to apply buoyant forces along at least part of the submerged length of a marine riser.

Techniques used in the prior art for maintaining constant upward tension on marine risers and guidelines have generally employed gas-over-oil hydraulic cylinders and accumulators for applying tension through complex pulley systems requiring cables and sheaves or chains and sprockets. In a typical marine riser tensioning system of the prior art, sheaves were attached to the floating structure on the ocean surface, and tensioning cables were run upward from the riser and over the sheaves (one cable for each sheave) so that the riser was suspended from the sheaves by the tensioning cables. Each tensioning cable was connected to a hydraulic cylinder, which allowed the cable to move in either direction over its corresponding sheave as necessary to maintain a constant upward tension on the riser. The hydraulic cylinders were typically actuated by accumulators that were sized to permit only small variations in tension on the riser over a wide range of vertical position changes for the floating structure relative to the riser.

It was common in the prior art for marine riser tensioning cables to be attached to lugs on a bearing ring fitted over and affixed to the upper end of the riser. The cables applied an upward tensioning force to the riser via the bearing ring, which was free to rotate around the riser so as to permit rotational motion of the riser relative to the floating structure. The bearing ring generally contained lubrication means to minimize the transfer of torque between the floating structure and the riser. Suspension of a marine riser by tensioning cables accommodated changes in position of the floating structure relative to the riser without imposing bending moments on the riser. However, such prior art tensioning systems generally had limited operational life, and required frequent and substantial maintenance efforts. In particular, marine riser tensioning systems of the prior art frequently sustained tensioning cable failures due to metal fatigue, and encountered leakage problems associated with hydraulic and pneumatic seals.

Techniques used in the prior art for maintaining constant upward tension on guidelines generally included use of means similar to those described above for tensioning marine risers. Thus, for guidelines as well as for marine risers, the prior art provided no practical alternative to the use of cables or chains and hydraulic cylinders for applying upward tension.

SUMMARY OF THE INVENTION

It is an object of the present invention to provide a gravity actuated system capable of maintaining substantially constant tension on marine risers and guidelines as used in offshore drilling and production operations.

It is a further object of the present invention to maintain substantially constant tension on marine risers and/or guidelines by means of a tensioning system that requires less troublesome and less costly maintenance than was required by tensioning systems known to the prior art. A tensioning system for marine risers and/or guidelines according to the present invention characteristically does not use cables and sheaves or chains and sprockets, and does not use hydraulic or pneumatic devices, thereby obviating the most onerous maintenance problems that had been experienced with tensioning systems of the prior art.

In general terms, a tensioning system according to the present invention maintains substantially constant upward tension on an elongate structure (e.g., a marine riser or guideline) extending between a buoyant object and a stationary underwater object (e.g., between a floating structure on the ocean surface and stationary drilling or production equipment on the ocean floor). The invention utilizes a double rack and pinion means, which comprises at least one (and preferably more than one) double rack and pinion combination for transferring a substantially constant upwardly directed tensioning force to the elongate structure from a massive weighted structure that is urged downward by gravity.

Each double rack and pinion combination comprising the overall double rack and pinion means includes a first rack in contact with the elongate structure to the upwardly tensioned, a second rack secured to the weighted structure urged downward by gravity, and a pinion secured to the buoyant object. The pinion has a cylindrical denticulate surface, and is supported in a horizontally fixed spacing between the first and second racks for rotational motion about the cylindrical axis of the denticulate surface. Teeth on the denticulate surface of the pinion are configured to mesh with corresponding teeth of the first and second racks so as to accommodate rotational motion of the pinion as the buoyant object changes vertical position relative to the elongate structure secured to the stationary underwater object.

Rotational motion of the pinion of each double rack and pinion combination occurs as teeth of the second rack of the combination engage a corresponding group of teeth (designated the second group of teeth) on the denticulate surface of the pinion. The downward gravitational force on the weighted structure to which the second rack is secured causes a torque to be applied to the second group of teeth on the surface of the pinion, thereby tending to rotate the pinion about its cylindrical axis. Simultaneously, a corresponding first group of teeth on the denticulate surface of the pinion engage teeth of the first rack of the double rack and pinion combination. The torque applied by the second rack to the pinion causes the pinion to exert an upward force on the first rack, which is restrained from moving vertically upward because the elongate structure with which the first rack is in contact remains secured to the stationary underwater object.

Preferably, the first racks of the various double rack and pinion combinations are attached to or formed integrally on the surface of a sleeve surrounding the elongate structure to be tensioned. The upward force exerted on each of the first racks by the corresponding pinion is transmitted to the elongate structure via the sleeve through a ring-shaped thrust bearing that surrounds the elongate structure. A shoulder is affixed to or formed integrally on a surface portion of the elongate structure, and the thrust bearing bears against the shoulder with a net upward tensioning force equal to the sum of the upward forces applied to all of the first racks of the various double rack and pinion combinations comprising the double rack and pinion means of this invention. Use of a thrust bearing for transmitting the tensioning force to the elongate structure accommodates heading changes of the buoyant object relative to the stationary underwater object, and also enables the elongate structure to be rotated if necessary during the process of being connected to the underwater object.

As the buoyant object on the ocean surface undergoes changes in vertical position due to waves, tides, winds, etc., the pinion of each double rack and pinion combination undergoes corresponding changes in vertical position by travelling up or down along the first rack of the combination. Vertical travel of the pinion along the first rack produces concomitant vertical motion of the weighted structure relative to the elongate structure. In effect, the pinion lifts or lowers the weighted structure as the buoyant object rises or falls on the surface of the water. In this way, a substantially constant upward force is exerted by the pinion on the first rack of each double rack and pinion combination regardless of the vertical position of the pinion. A substantally constant net upward tensioning force is thus exerted on the elongate structure by the overall double rack and pinion tensioning means.

In the preferred embodiment of the present invention, the double rack and pinion means comprises three double rack and pinion combinations arranged symmetrically with respect to each other around the elongate structure to be tensioned. The weighted structure, according to the preferred embodiment, is of generally cylindrical configuration and is positioned coaxially around a portion of the elongate structure above the surface of the water. The first racks of the three double rack and pinion combinations are formed on the surface of a sleeve that surrounds the elongate structure, and the second racks of the combinations are secured to the inner cylindrical wall of the weighted structure. Three pinions (i.e., one pinion for each of the double rack and pinion combinations) are mounted on support members attached to the buoyant object. Each pinion is positioned in the spacing between a corresponding pair of first and second racks. The support members may be, for example, rods attached to a deck on the buoyant object by means of ball joints to accommodate relative motion of the buoyant object with respect to the first and second racks.

An alignment means assures proper engagement of the pinion teeth with the teeth of the first and second racks by maintaining the desired spacing and parallelism between the first and second racks. The preferred alignment means comprises a plurality of rollers secured to the inner cylindrical wall of the weighted structure and positioned so as to bear against side portions of each of the first racks on the sleeve surrounding the elongate structure.

BRIEF DESCRIPTION OF THE DRAWING

FIG. 1 is a generalized cross-sectional representation of an off-shore drilling or production apparatus without means for tensioning a marine riser, with the riser consequently being subject to bending and buckling as shown.

FIG. 2 is a cross-sectional representation of an offshore drilling or production apparatus having a tensioning means according to the present invention for maintaining substantially constant upward tension on a marine riser.

FIG. 3 is a cut-away partially exploded perspective view of a marine riser tensioning means according to the present invention.

BEST MODE OF CARRYING OUT THE INVENTION

Figure 5:
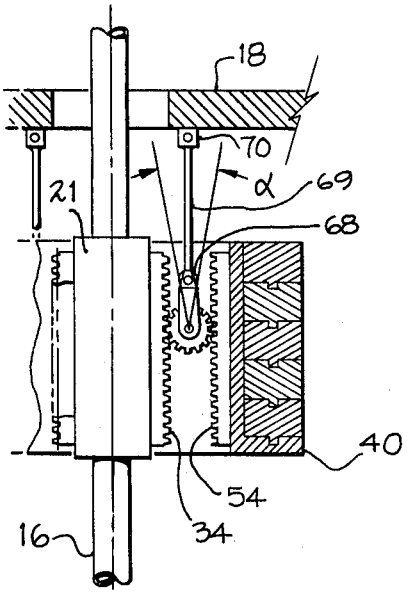
FIG. 5 is a cross-sectional view in the vertical plane of the marine riser tensioning means of FIG. 3.

Apparatus for use in offshore drilling and/or production operations is shown schematically in FIGS. 1 and 2. A buoyant object 10, which may be a vessel having a ship-shaped hull or an otherwise configured floating platform, is maintained on station on the surface of the ocean over a drill site or production well on the ocean floor. Stationary equipment 11 on the ocean floor defines the location where the drilling and/or production operations are to occur.

As represented in FIGS. 1 and 2, the buoyant object 10 is a floating platform, which is anchored to the ocean floor by conventional means, e.g., lines 12 and 13 and mooring blocks 14 and 15. An elongate conduit structure 16 called a marine riser extends between the floating platform 10 and the stationary equipment 11. The riser 16 is referred to as a drilling riser or a production riser, depending upon whether the operation is a drilling operation or a production operation. In the case of a drilling operation, the stationary equipment 11 would typically include a blow-out preventer (BOP), and in the case of a production operation the stationary equipment 11 would typically include a subsea manifold for connecting flowlines leading from the well to one or more transport conduits enclosed within the riser 16.

The platform 10 undergoes a variety of heaving and swaying motions relative to the stationary equipment 11 in response to varying maritime conditions (e.g., waves, tides, winds, surface and sub-surface currents, and other phenomena occurring on or near the surface of the ocean). The solid lines in FIGS. 1 and 2 show the platform 10 in a position directly over the stationary equipment 11. The broken lines in FIGS. 1 and 2, which show a phantom platform 10' with phantom mooring lines 12' and 13' and a phantom riser 16', indicate a position for the platform 10 that is displaced both horizontally and vertically from the position directly over the stationary equipment 11. The phantom platform 10' thus indicates any position to which the platform 10 might be moved on the ocean surface due to maritime conditions prevailing during drilling and/or production operations. In operation, however, the riser 16 must be maintained at a substantially constant upward tension, regardless of any movement of the platform 10, in order to prevent compressional loading that would otherwise cause the riser 16 to buckle or bend.

The illustration in FIG. 1 represents an apparatus not having means for upwardly tensioning the riser 16. Consequently, as illustrated to an exaggerated extent by the phantom riser 16', the riser 16 is subject to buckling and bending as the platform 10 heaves, pitches, rolls, surges and sways on the ocean surface.

The illustration in FIG. 2 represents an apparatus having means 17 according to the present invention for upwardly tensioning the riser 16. The tensioning means 17 is suspended from deck 18 of the platform 10 above the surface of the ocean. When environmental forces cause the platform 10 to be displaced to a position indicated by phantom platform 10', the deck 18 is concomitantly displaced to a position indicated by phantom deck 18'. In general, when the platform 10 moves, the deck 18 undergoes not only horizontal and vertical displacements but also angular displacement or tilt. Regardless of the position assumed by the deck 18, however, the riser 16 remains under substantially constant upward tension.

When environmental forces act on the platform 10, the riser 16 and the tensioning means 17 undergo angular displacement to positions indicated by phantom riser 16' and phantom tensioning means 17'. However, regardless of the position of the platform 10 for sea state conditions within the operational capability of the riser 16, the tensioning means 17 continually provides a substantially uniform tension in the upward direction on the riser 16.

The riser 16 is typically installed by being run downward from the platform 10 toward the ocean floor in discrete cylindrical pipe segments, which are attached to each other one after the other until the complete riser 16 is fabricated and ready for coupling to the stationary equipment 11. Conventionally, the riser 16 is coupled to the stationary equipment 11 by means of a remotely operated connector.

The tensioning means 17 is shown in detail in FIG. 3. The riser 16 is run downward, segment by segment, toward the ocean floor through a ring-shaped thrust bearing 20 and a generally cylindrical sleeve 21. A collar 22 is affixed to or formed integrally with a cylindrical segment at the upper end of the riser 16 above the surface of the ocean. The sleeve 21 and the thrust bearing 20 thus surround the riser 16, with the thrust bearing 20 being interposed between the sleeve 21 and the collar 22.

Figure 4:
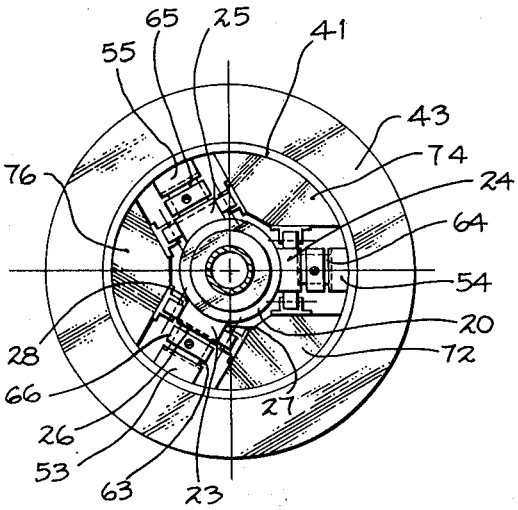
FIG. 4 is a plan view of the marine riser tensioning means of FIG. 3.

A plurality of ribs (e.g., the three ribs 23, 24 and 25 as shown in FIGS. 3 and 4) project outward from the cylindrical surface and run parallel to the cylindrical axis of the sleeve 21. Each of the ribs 23, 24 and 25 presents a generally rectangular aspect when viewed frontally or from either side. Thus, rib 23 has a flat rectangular front face 26 and two flat rectangular side faces 27 and 28 as seen in FIGS. 3 and 4. The other ribs 24 and 25 are similarly configured. A denticulate rack 33 is affixed to or formed integrally with the flat front face 26 of the rib 23. In like manner, corresponding denticulate racks 34 and 35 (rack 35 not visible in the drawing), each of which has a configuration identical to the configuration of the rack 33, are attached to or formed integrally with the flat front faces of the ribs 24 and 25, respectively.

A cylindrical weighted structure 40 coaxially surrounds the riser 16 adjacent but spaced apart from the cylindrical sleeve 21. The weighted structure 40 preferably comprises a relatively thin wall portion 41 having an outwardly extending flange 42 at its lower end. The flange 42 is generally perpendicular to the riser 16, and serves as a shelf upon which arcuately configured weighting segments 43 can be stacked and secured to provide the required total weight for the weighted structure 40. The individual weighting segments 43 may be made of steel, concrete, or any other dense material suitable for prolonged exposure to a marine environment. Alternatively, the weighted structure 40 could be a unitary structure made of dense material such as concrete, or a hollow structure filled with a dense fluid material such as drill mud. In the embodiment shown in FIG. 3, tabs are shown on the lower surfaces and dentents are shown on the upper surfaces of the weighting segments 43 in order to secure the individual segments 43 in position. Other techniques would be possible, however, for securing the weighting segments 43 in position. The particular design features of the weighted structure 40 can be selected according to economic considerations and/or the initial installation conditions.

Denticulate racks 53, 54 and 55 are secured to the interior surface of the wall portion 41 of the weighted structure 40 in alignment with and facing the racks 33, 34 and 35, respectively. Thus, each of the pairs of racks 33 and 53, 34 and 54, and 35 and 55, respectively, defines a spacing between the riser 16 and the weighted structure 40. Pinions 63, 64 and 65 are positioned in the spacings between the corresponding racks of the pairs 33 and 53, 34 and 54, and 35 and 55, respectively. As shown in FIG. 3 where the tensioning means 17 is below the deck 18 of the platform 10, each of the pinions 63, 64 and 65 is suspended from the deck 18. However, in an alternative embodiment where the tensioning means 17 would be above the deck 18, the pinions 63, 64 and 65 would be supported on stanchions extending upward from the deck 18 into the spacings between the corresponding racks. Each of the pinions 67, 68 and 69 has a denticulate cylindrical surface, whose teeth are dimensioned to mesh with teeth on the pair of corresponding racks between which the pinion is positioned.

Figure 6:
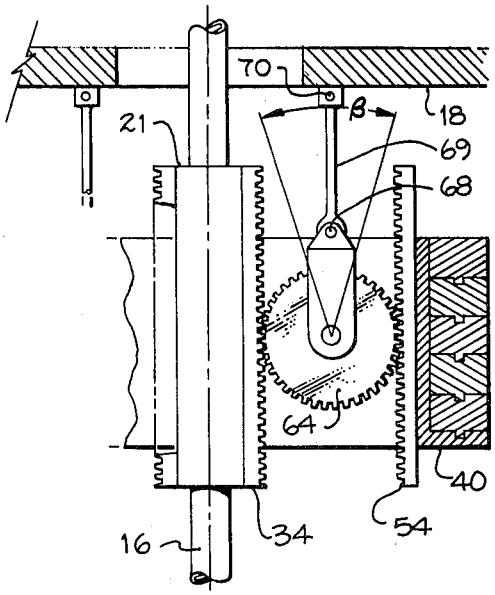
FIG. 6 is a cross-sectional view in the vertical plane of an alternative rack and pinion configuration for the marine riser tensioning means of FIG. 3.

Referring to FIG. 3, the pinion 63, which is substantially identical to the pinions 64 and 65, is mounted within a bracket 66 for rotation about an axial member 67 in the spacing between the facing racks 33 and 53. The bracket 66 is connected by a ball joint 68 to the lower end of a support rod 69. The other (i.e., upper) end of the support rod 69 is connected to the deck 18 of the floating platform 10 by another ball joint 70. The ball joints 68 and 70 may be of conventional design having spherical ball members secured by pin connections to mounting brackets as illustrated in FIGS. 3, 5 and 6. The ball joints 68 and 70 accommodate changes in the relative angular positions of the floating platform 10 and the riser 16.

The diameter of the pinions 63, 64 and 65 is sized for the particular operating conditions, and depends on general response characteristics of the buoyant object to changes in sea state as well as on particular conditions at the drilling or production site. FIGS. 5 and 6 illustrate particular pinion sizes and rack configurations, which are merely representative of a wide variety of configurations possible for the practice of this invention. In general, for a given set of sea state and other maritime conditions, a floating platform of the semi-submersible type would undergo smaller motions than would a ship of conventional hull design. Thus, the double rack and pinion arrangement shown in FIG. 5 might ordinarily be associated with a floating platform of the semi-submersible type where angular deviations of the support rod 69 from the vertical are relatively small. The double rack and pinion arrangement shown in FIG. 6 on the other hand might ordinarily be associated with a ship of conventional hull design, thus requiring a pinion of larger diameter to accommodate larger angular deviations of the support rod 69 from the vertical.

Similarly, the other pinions 64 and 65 are also secured to the deck 18 of the floating platform 10 in the same manner. The pinions 63, 64 and 65 are of substantially uniform diameter so that the horizontal spacing is substantially the same between the racks 33 and 53, 34 and 54, and 35 and 55. The pinions 63, 64 and 65, being secured to the floating platform 10, undergo vertical motions corresponding to the vertical motions of the floating platform 10.

To maintain alignment of the teeth on the pinion 63 with corresponding teeth on the pair of racks 33 and 53, and likewise of the teeth on the pinions 64 and 65 with corresponding teeth on the pairs of racks 34 and 54, and 35 and 55, respectively, an alignment mechanism is provided in the preferred embodiment of the present invention. As shown in FIGS. 3 and 4, upper and lower sector plates 71 and 72, respectively, are attached to the inner surface of the wall portion 41 of the weighted structure 40. The sector plates 71 and 72 project horizontally inward toward the sleeve 21 in the angular separation between the ribs 23 and 24. Similarly, as shown in FIGS. 3 and 4, inwardly projecting horizontal sector plates 73 and 74 are attached to the inner surface of the wall portion 41 projecting into the angular separation between the ribs 24 and 25; and inwardly projecting horizontal sector plates 75 and 76 are attached to the inner surface of the wall portion 41 projecting into the angular separation between the ribs 25 and 26.

Brackets supporting rollers 81, 82, 83 and 84 are mounted on the sector plates 71 and 72. The rollers 81, 82, 83 and 84 bear against the flat side faces of the ribs 23 and 24, as shown in FIGS. 3 and 4. Thus, the rollers 81 and 82 are mounted for rotation in corresponding brackets that are attached to the upper and lower sector plates 71 and 72, respectively, so that the rollers 81 and 82 bear against the side face 27 of the rib 23. Likewise the rollers 83 and 84 are mounted in brackets attached to the sector plates 71 and 72, respectively, so as to bear against a side face (unnumbered in the drawing) of the rib 24. In like manner, the sector plates 73 and 74 support rollers that bear against the flat side faces of the ribs 24 and 25; and the sector plates 75 and 76 support rollers that bear against the flat side faces of the ribs 25 and 23. The various rollers function cooperatively as an alignment mechanism to ensure proper operation of the double rack and pinion gearing. Shims 85 may be provided between the various sector plates and the roller-supporting brackets mounted thereon. The shims 85 provide a means to correct for accumulations of manufacturing tolerances when adjusting the tensioning means 17 for operational use.

In operation, teeth on each of the pinions 63, 64 and 65 engage teeth on the racks 53, 54 and 55, respectively, secured to the weighted structure 40. The downward gravitational force on the weighted structure 40 causes a torque to be applied to the pinions 63, 64 and 65 tending to rotate them about their axial members. As shown in FIG. 3, the pinion 63 thus tends to rotate counterclockwise about its axial member 67. Similarly, the other pinions 64 and 65 rotate about corresponding axial members. Other teeth on the pinions 63, 64 and 65 concomitantly engage teeth on the racks 33, 34 and 35, thereby exerting an upward force on the sleeve 21 to which the racks 33, 34 and 35 are attached. Upward travel of the sleeve 21 along the riser 16 is restrained, however, by the collar 22, which is attached to or integral with an upper segment (typically, the uppermost segment) of the riser 16. The upward force exerted by the pinions 63, 64 and 65 on the sleeve 21 is transmitted via the thrust bearing 20 to the collar 22. Since the lower end of the riser 16 is secured to the stationary equipment 11 on the ocean floor, the upward force exerted on the collar 22 tensions the riser 16 in the upward direction. Thus, the pinions 63, 64 and 65 in effect convert the downward force of gravity acting on the weighted structure 40 to an upward tensioning force acting on the riser 16.

As the floating platform 10 undergoes changes in position relative to the stationary equipment 11 due to waves, tides, winds, etc. acting on or near the ocean surface, the pinions 63, 64 and 65 undergo corresponding changes in position by travelling up or down along the racks 33, 34 and 35, respectively. Such vertical travel of the pinions 63, 64 and 65 up or down along the racks 33, 34 and 35, respectively, produces concomitant vertical motion of the weighted structure 40 relative to the riser 16. In effect, the pinions 63, 64 and 65 raise or lower the weighted structure 40 as the floating platform rises or falls on the ocean surface. In this way, a substantially constant upward tensioning force is exerted by the pinions 63, 64 and 65 on the riser 16 regardless of the position of the floating platform 10 relative to the stationary equipment 11.

Figure 7:
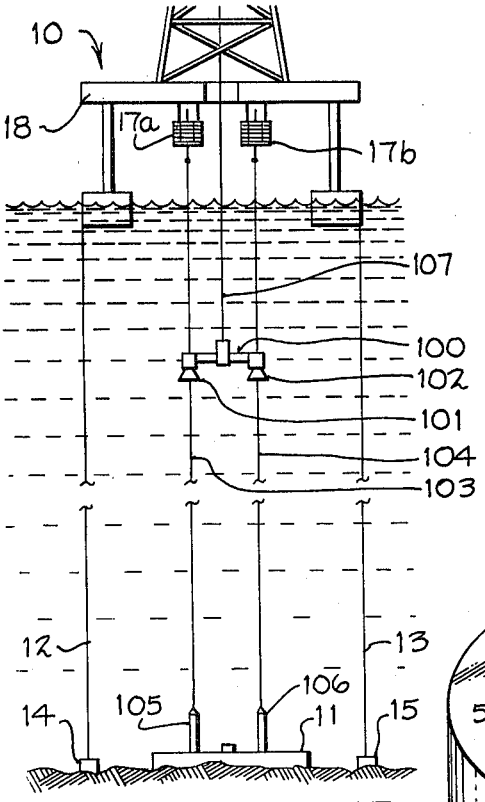
FIG. 7 is a cross-sectional representation of an offshore drilling or production apparatus having a tensioning means according to the present invention for maintaining substantially constant upward tension on guidelines.

The present invention has been described above in connection with the tensioning of a marine riser. However, the invention could also be utilized in the tensioning of guidelines for marine applications. As illustrated in FIG. 7, an item of equipment 100 to be located in proper position and orientation on to the ocean floor is coupled to guide tubes 101 and 102 that surround guidelines 103 and 104, respectively. The guidelines 103 and 104 are connected by conventional means 105 and 106, respectively, to the stationary equipment 11 already in place on the ocean floor. The equipment 100 is let down by lowering means 107, which is payed out from the floating platform 10. The guidelines 103 and 104 are each tensioned with a substantially constant upwardly directed force by means of tensioning devices **17*a* and 17*b***, respectively, in accordance with this invention.

Figure 8:
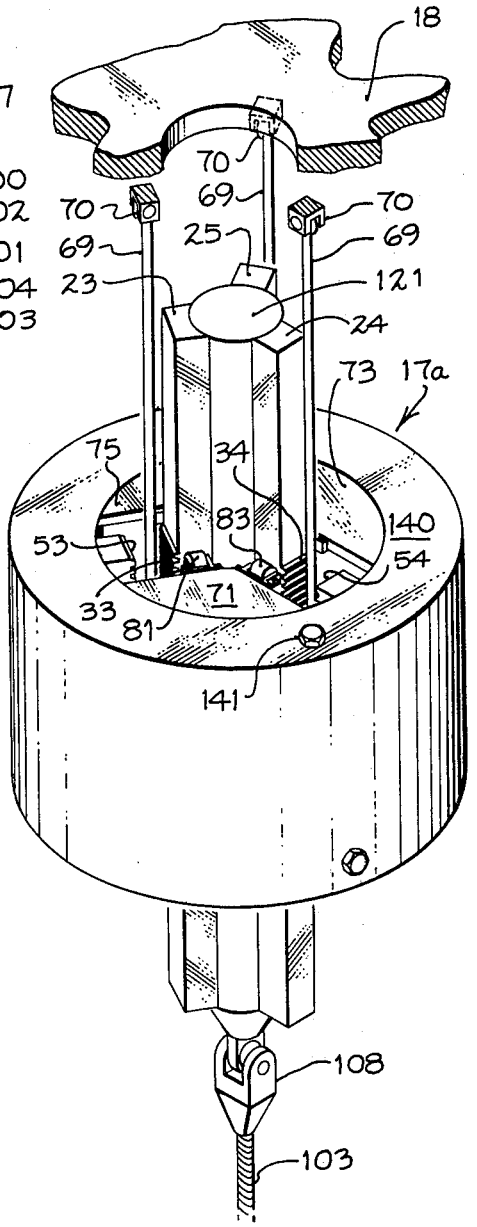
FIG. 8 is a perspective view of a tensioning means according to the present invention for maintaining substantially constant upward tension on a guideline.

As shown in detail in FIG. 8, the guideline 103 terminates in a conventional joint 108, which connects the guideline 103 with a generally cylindrical bar 121. The bar 121 is externally configured to resemble the sleeve 21 shown in FIG. 3, but is a solid structure rather than hollow as in the case of the sleeve 21. The bar 121 has projecting ribs 23, 24 and 25, just as in the case of the sleeve 21. Denticulate racks 33, 34 and 35 are affixed to or formed integrally with the front faces of the ribs 23, 24 and 25, respectively. A generally cylindrical weighted structure 140 coaxially surrounds the bar 121, just as the generally cylindrical weighted structure 40 surrounds the sleeve 21 in FIG. 3. The weighted structure 140 is shown as a tank into which a dense fluid material can be introduced via inlet port 141 to provide the required weight. The weighted structure 140 of FIG. 8 could be configured as the weighted structure 40 of FIG. 3, however, and vice versa.

Denticulate racks 53, 54 and 55 are affixed to the interior surface wall of the weighted structure 140 in positions facing the racks 33, 34 and 35, respectively, on the bar 121. Pinions (not seen in FIG. 8) are suspended by support rods 69 from the deck 18 of the floating platform 10, and extend into the annular spaces between the pairs of racks 33 and 53, 34 and 54, and 35 and 55, respectively. Sector plates (of which the upper sector plate 71, 73 and 75 can be seen in FIG. 8) support rollers (of which only the rollers 81 and 83 can be seen in FIG. 8), which bear against the ribs 23, 24 and 25 on the bar 121 to ensure proper operation of the double rack and pinion gearing. In operation, the tensioning devices **17*a* and 17*b*, which are structurally identical, function just as the tensioning means 17 of FIG. 3** as described above.

Figure 9:
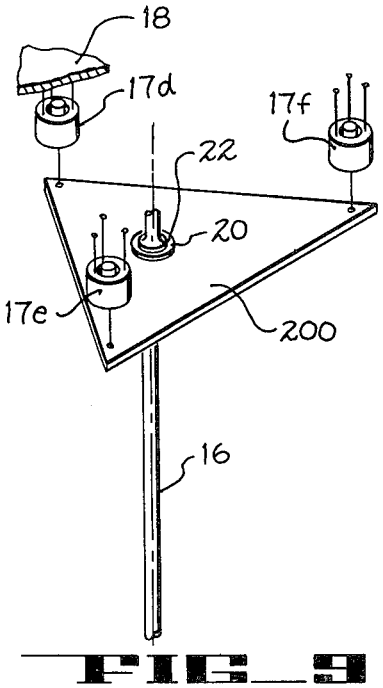
FIG. 9 is a perspective view of a tensioning device comprising a plurality of tensioning means according to the present invention.

In an alternative embodiment of the invention, the tensioning means 17 could comprise a plurality of tensioning devices for each elongate structure to be tensioned. For example, the riser 16 could be run through the thrust bearing 20 and through an aperture in a laterally extending member such as a triangular plate 200 as shown in FIG. 9. Tensioning devices 17*d*, 17*e* and 17*f* could be attached to the triangular plate 200, with one tensioning device at each corner thereof, to provide a resulting upward force on the plate 200. The upward force on the plate 200 is then transmitted via the thrust bearing 20 to the collar 22 affixed to or formed on an upper segment of the riser 16. Each of the tensioning devices 17*d*, 17*e* and 17*f* functions in the manner described above for the tensioning devices 17*a* and 17*b* of FIGS. 7 and 8. In principle, there are no restrictions on the configuration of the plate 200 that bears upwardly on the thrust bearing 20, and there are no restrictions on the number of tensioning devices that may be used to urge the plate 200 upward. Ordinarily, the aperture for the elongate structure 16 would be at the geometric center of the plate 200, and the tensioning devices would be symmetrically arranged around the perimeter of the plate 200.

Figure 10:
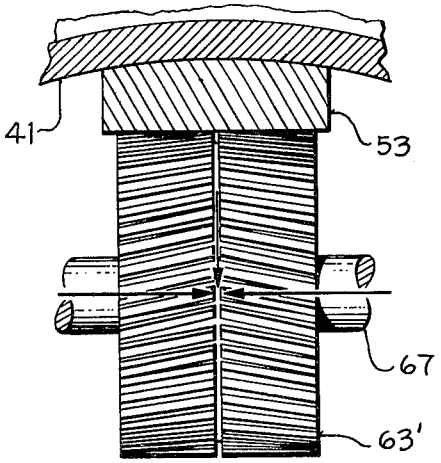
FIG. 10 is a front elevational view of an alternative configuration for the teeth of the pinions of FIGS. 3 and 8.

In the usual case, the teeth on the denticulate surface of each pinion would be of the spur gear type as indicated in FIGS. 3, 5, 6 and 8. However, a herringbone configuration for the pinion teeth, as illustrated by pinion 63' in FIG. 10, would be useful in certain applications where a self-centering tendency is desirable.

The functional equivalent of a double rack and pinion device according to the present invention might be fashioned by replacing the denticulate racks with chains, and by replacing the pinion with a sprocket whose teeth mesh with the links of the chains. Such a chain and sprocket device, while having the inherent limitations affecting chains and sprockets, would nevertheless be within the scope of the present invention if used in a double rack and pinion arrangement.

Other design variations would be apparent to a practitioner skilled in the art from a study of the accompanying drawing. For example, the thrust bearing 20 shown in FIG. 3 may not be needed in all applications, and the racks 33, 34 and 35 could be attached directly to an upper segment of the riser 16. Also, the support rods 69 need not necessarily be rigid in all applications, and could be replaced by steel cables or even chains.

Various alternative arrangements are also possible for the rollers that align the pinions with their corresponding pairs of racks. As shown in FIG. 3, the rollers 81, 82, 83 and 84 are secured to the weighted structure 40 so as to bear against portions of the sleeve 21. However, in principle, the rollers could be secured to the sleeve 21 so as to bear against portions of the weighted structure 40. Also, the rollers could be mounted on the pinion brackets, as represented by the bracket 66 in FIG. 3, so as to bear against portions of the sleeve 21 and the weighted structure 40. In particular applications, a first set of rollers could be secured to the sleeve 21 and a second set of rollers could be secured to the weighted structure 40, with both sets of rollers bearing against guideposts or other structure extending from the deck 18 into the spacing between the sleeve 21 and the weighted structure 40.

In particular applications, the cylindrical rollers 81, 82, 83, 84, etc. described above in connection with FIGS. 3 and 8 could be replaced by double conical rollers or V-shaped rollers. The rollers might even be replaced altogether by sliding shoes in particular applications.

A tensioning system according to the present invention for marine risers and guidelines has been described above in terms of particular embodiments. However, since other embodiments of the invention would be apparent to workers skilled in the art upon perusal of the above description and accompanying drawing, the above description is to be considered merely as illustrative of the invention. The invention is defined by the following claims and their equivalents.

I claim:

1. A method of maintaining substantially constant tension on an elongate structure, said elongate structure being secured to a stationary underwater object and extending upward to a buoyant object, said method comprising the steps of:

(a) positioning a weighted structure in proximity to said elongate structure;

(b) positioning first rack means to interact with said elongate structure so that said elongate structure restrains upward motion of said first rack means;

(c) securing second rack means to said weighted structure, said second rack means facing said first rack means;

(d) securing pinion means to said buoyant object, said pinion means extending between said first and second rack means and having teeth that mesh with corresponding teeth on said first and second rack means, gravity acting downward on said weighted structure thereby causing said second rack means to exert a torque on said pinion means that causes said pinion means to impart an upward force to said first rack means, said pinion means undergoing rotational motion as said buoyant object changes position relative to said underwater object, said rotational motion of said pinion means causing said pinion means to travel vertically along said first rack means and to produce concomitant vertical motion of said weighted structure relative to said elongate structure, said upward force imparted to said first rack means remaining substantially constant as said pinion means travels along said first rack means, thereby causing a substantially constant upward tension to be transmitted to said elongate structure.

2. The method of claim 1 wherein the step of positioning said weighted structure in proximity to said elongate structure comprises positioning a weighted structure around said first rack means.

3. The method of claim 2 wherein the step of positioning said first rack means to interact with said elongate structure comprises attaching a first plurality of racks to external surface portions of a sleeve, said sleeve being positioned around said elongate structure, upward motion of said sleeve being restrained by a collar attached to said elongate structure.

4. The method of claim 3 wherein the step of securing said second rack means to said weighted structure comprises attaching a second plurality of racks to an inner wall portion of said weighted structure, each rack of said second plurality of racks on said weighted structure facing a corresponding rack of said first plurality of racks on said sleeve.

5. The method of claim 4 wherein the step of securing said pinion means to said buoyant object comprises attaching a plurality of pinions to support members affixed to said buoyant object, said support members extending into spacing between said first and second rack means so that each pinion is positioned between one of the racks on said sleeve and one of the racks on said weighted structure.

6. The method of claim 5 wherein corresponding racks of said first and second rack means are aligned with each other by means of rollers, said rollers being secured to structure supporting racks of one of said rack means so as to bear against structure supporting racks of the other of said rack means.

7. The method of claim 6 wherein said rollers are secured to said weighted structure so as to bear against portions of said sleeve.

8. The method of claim 6 wherein said rollers are secured to said sleeve so as to bear against portions of said weighted structure.

9. The method of claim 5 wherein corresponding racks of said first and second rack means are aligned with each other by means of rollers, said rollers being secured to said pinion support members so as to bear against portions of said sleeve and said weighted structure.

10. The method of claim 5 wherein corresponding racks of said first and second rack means are aligned with each other by means of first and second sets of rollers, the rollers of said first set being secured to said sleeve and the rollers of said second set being secured to said weighted structure, the rollers of said first and second sets bearing against structure extending from said buoyant object into spacing between said sleeve and said weighted structure.

11. The method of claim 2 wherein the step of positioning said first rack means to interact with said elongate structure comprises attaching a first plurality of racks to surface portions of a bar that is fastened to the upper end of said elongate structure, said bar extending collinearly with respect to said elongate structure.

12. The method of claim 11 wherein the step of securing said second rack means to said weighted structure comprises attaching a second plurality of racks to an inner wall portion of said weighted structure, each rack of said second plurality of racks on said weighted structure facing a corresponding rack of said first plurality of racks on said bar.

13. The method of claim 12 wherein the step of securing said pinion means to said buoyant object comprises attaching a plurality of pinions to support members affixed to said buoyant object, said support members extending between said first and second rack means so that each pinion is positioned between a rack on said bar and a rack on said weighted structure.

14. The method of claim 13 wherein corresponding racks of said first and second rack means are aligned with each other by means of rollers, said rollers being secured to structure supporting racks of one of said rack means so as to bear against structure supporting racks of the other of said rack means.

15. The method of claim 14 wherein said rollers are secured to said weighted structure so as to bear against surface portions of said bar.

16. An apparatus for maintaining substantially constant tension on an elongate structure, said elongate structure being secured to a stationary underwater object and extending upward to a buoyant object, said apparatus comprising:

(a) a weighted structure positioned in proximity to said elongate structure;

(b) first rack means positioned to interact with said elongate structure so that said elongate structure restrains upward motion of said first rack means;

(c) second rack means secured to said weighted structure, said second rack means facing said first rack means; and (d) pinion means secured to said buoyant object, said pinion means extending between said first and second rack means and having teeth that mesh with corresponding teeth on said first and second rack means, gravity acting downward on said weighted structure thereby causing said second rach means to exert a torque on said pinion means that causes said pinion means to impart an upward force to said first rack means, said pinion means undergoing rotational motion as said buoyant object changes position relative to said underwater object, said rotational motion of said pinion means causing said pinion means to travel vertically along said first rack means and to produce concomitant vertical motion of said weighted structure relative to said elongate structure, said upward force imparted to said first rack means remaining substantially constant as said pinion means travels along said first rack means, thereby causing a substantially constant upward tension to be transmitted by said first rack means to said elongate structure.

17. The apparatus of claim 16 wherein said weighted structure surrounds said first rack means.

18. The apparatus of claim 17 wherein said weighted structure comprises a number of weighting segments, the number of said weighting segments being selected to determine the magnitude of the upward tension transmitted to said elongate structure.

19. The apparatus of claim 17 wherein said weighted structure comprises a tank for receiving a fluid, the quantity of said fluid introduced into said tank determining the magnitude of the upward tension transmitted to said elongate structure.

20. The apparatus of claim 17 wherein said first rack means comprises a first plurality of racks attached to external surface portions of a sleeve, said sleeve being positioned around said elongate structure, upward motion of said first rack means being restrained by a collar attached to said elongate structure.

21. The apparatus of claim 20 wherein the racks of said first plurality are arranged symmetrically around said sleeve.

22. The apparatus of claim 20 wherein said second rack means comprises a second plurality of racks attached to an inner wall of said weighted structure, each rack of said second plurality of racks on said weighted structure facing a corresponding rack of said first plurality of racks on said sleeve.

23. The apparatus of claim 22 wherein said pinion means comprises a plurality of pinions attached to support members affixed to said buoyant object, said support members extending into spacing between said first and second rack means so that each pinion is positioned between one of the racks on said sleeve and one of the racks on said weighted structure.

24. The apparatus of claim 23 wherein corresponding racks of said first and second rack means are aligned with each other by means of rollers, said rollers being secured to structure supporting racks of one of said rack means so as to bear against structure supporting racks of the other of said rack means.

25. The apparatus of claim 24 wherein said rollers are secured to said weighted structure so as to bear against portions of said sleeve.

26. The apparatus of claim 24 wherein said rollers are secured to said sleeve so as to bear against portions of said weighted structure.

27. The apparatus of claim 23 wherein corresponding racks of said first and second rack means are aligned with each other by means of rollers, said rollers being secured to said pinion support members so as to bear against portions of said sleeve and said weighted structure.

28. The apparatus of claim 23 wherein corresponding racks of said first and second rack means are aligned with each other by means of first and second sets of rollers, the rollers of said first set being secured to said sleeve and the rollers of said second set being secured to said weighted structure, the rollers of said first and second sets bearing against structure extending from said buoyant object into spacing between said sleeve and said weighted structure.

29. The apparatus of claim 17 wherein said first rack means comprises a first plurality of racks attached to external surface portions of a bar fastened to the upper end of said elongate structure, said bar extending collinearly with respect to said elongate structure.

30. The apparatus of claim 29 wherein the racks of said first plurality are arranged symmetrically around said bar.

31. The apparatus of claim 29 wherein said second rack means comprises a second plurality of racks attached to an inner wall of said weighted structure, each rack of said second plurality of racks on said weighted structure facing a corresponding rack on said first plurality of racks on said bar.

32. The apparatus of claim 31 wherein said pinion means comprises a plurality of pinions attached to support members affixed to said buoyant object, said support members extending into spacing between said first and second rack means so that each pinion is positioned between one of the racks on said bar and one of the racks on said weighted structure.

33. The apparatus of claim 32 wherein corresponding racks of said first and second rack means are aligned with each other by means of rollers, said rollers being secured to structure supporting racks of one of said rack means so as to bear against structure supporting racks of the other of said rack means.

34. The apparatus of claim 33 wherein said rollers are secured to said weighted structure so as to bear against portions of said bar.

35. The apparatus of claim 33 wherein said rollers are secured to said bar so as to bear against portions of said weighted structure.

36. The apparatus of claim 32 wherein corresponding racks of said first and second rack means are aligned with each other by means of rollers, said rollers being secured to said pinion support members so as to bear against portions of said bar and said weighted structure.

37. The apparatus of claim 32 wherein corresponding racks of said first and second rack means are aligned with each other by means of first and second sets of rollers, the rollers of said first set being secured to said bar and the rollers of said second set being secured to esaid weighted structure, the rollers of said first and second sets bearing against structure extending from said buoyant object into spacing between said bar and said weighted structure.

38. An apparatus for maintaining substantially constant tension on an elongate structure, said elongate structure being secured to a stationary underwater object and extending upward to a buoyant object, said apparatus comprising:

(a) a lateral member having an aperture through which said elongate structure passes;

(b) means for maintaining substantially constant upward tension on said lateral member, said tensioning means including a plurality of tensioning devices connecting said lateral member to said buoyant object, each of said tensioning devices being a double rack and pinion device having:

(i) a bar on which first rack means is formed;

(ii) a generally cylindrical weighted structure surrounding said bar, second rack means being secured to said weighted structure, said second rack means facing said first rack means; and (iii) pinion means secured to said buoyant object, said pinion means extending between said first and second rack means and having teeth that mesh with corresponding teeth on said first and second rack means, gravity acting downward on said weighted structure thereby causing said second rack means to exert a torque on said pinion means that causes said pinion means to permit an upward force to said first rack means, said pinion means undergoing rotational motion as said buoyant object changes position relative to said underwater object, said rotational motion of said pinion means causing said pinion means to travel vertically along said first rack means and to produce concomitant vertical motion of said weighted structure relative to said bar, said upward force imparted to said first rack means remaining substantially constant as said pinion means travels along said first rack means, thereby causing a substantially constant upward tension to be transmitted by said first rack means to said bar; and (c) means for transmitting upward tension from said lateral member to said elongate structure.

39. The apparatus of claim 38 wherein said means for transmitting upward tension from said lateral member to said elongate structure comprises a ring-like thrust bearing surrounding said elongate structure, said thrust bearing being disposed between said lateral member and a collar projecting from said elongate structure, said thrust bearing exerting an upward force on said collar when upward tension is applied to said lateral member.

40. The apparatus of claim 38 wherein said first rack means includes a plurality of first racks and said second rack means includes a plurality of second racks, each first rack facing a corresponding second rack.

41. The apparatus of claim 40 wherein corresponding racks of said first and second rack means are aligned with each other by means of rollers.

42. A system for recovering energy resources from a deposit located beneath the floor of a body of water, said system comprising:

(a) a floating structure to be positioned on the surface of the body of water generally over the deposit;

(b) stationary equipment to be positioned on the floor of the body of water generally over the deposit;

(c) an elongate riser extending between said floating structure and said stationary equipment; and (d) double rack and pinion means for maintaining substantially constant upward tension on said riser, said double rack and pinion means including:
(i) a weighted structure surrounding said riser;
(ii) first rack means positioned to interact with said riser so that said riser restrains upward motion of said first rack means;
(iii) second rack means secured to said weighted structure, said second rack means facing said first rack means; and
(iv) pinion means secured to said floating structure, said pinion means extending between said first and second rack means and having teeth that mesh with corresponding teeth on said first and second rack means, gravity acting downward on said weighted structure causing said second rack means to exert a torque on said pinion means that causes said pinion means to impart an upward force to said first rack means, said pinion means undergoing rotational motion as said floating structure changes position relative to said stationary equipment, said rotational motion of said pinion means causing said pinion means to travel vertically along said first rack means and to produce concomitant vertical motion of said weighted structure relative to said riser, said upward force imparted to said first rack means remaining substantially constant as said pinion means travels along said first rack means, thereby causing a substantially constant upward tension to be transmitted to said riser.

43. The system of claim 42 wherein said first rack means comprises a first plurality of racks attached to external surface portions of a sleeve, said sleeve being positioned around said riser, upward motion of said sleeve being restrained by a collar attached to said riser.

44. The system of claim 43 wherein said second rack means comprises a second plurality of racks attached to an inner wall of said weighted structure, each rack of said second plurality of racks on said weighted structure facing a corresponding rack on said first plurality of racks on said sleeve.

45. The system of claim 42 wherein said first rack means comprises a first plurality of racks attached to said riser.

46. The system of claim 45 wherein said second rack means comprises a second plurality of racks attached to an inner wall of said weighted structure, each rack of said second plurality of racks facing a corresponding rack on said first plurality.

* * * * *